US010891855B2

(12) United States Patent
Zou et al.

(10) Patent No.: US 10,891,855 B2
(45) Date of Patent: Jan. 12, 2021

(54) METHOD TO SCHEDULE INTELLIGENT TRAFFIC LIGHTS IN REAL TIME BASED ON DIGITAL INFOCHEMICALS

(71) Applicant: DALIAN UNIVERSITY OF TECHNOLOGY, Liaoning (CN)

(72) Inventors: Guangyu Zou, Liaoning (CN); Dan Shi, Liaoning (CN); Lili Zhang, Liaoning (CN)

(73) Assignee: DALIAN UNIVERSITY OF TECHNOLOGY, Liaoning (CN)

( * ) Notice: Subject to any disclaimer, the term of this patent is extended or adjusted under 35 U.S.C. 154(b) by 0 days.

(21) Appl. No.: 16/753,455

(22) PCT Filed: Jul. 16, 2019

(86) PCT No.: PCT/CN2019/096138

§ 371 (c)(1),
(2) Date: Apr. 3, 2020

(87) PCT Pub. No.: WO2020/042789

PCT Pub. Date: Mar. 5, 2020

(65) Prior Publication Data

US 2020/0320872 A1 Oct. 8, 2020

(30) Foreign Application Priority Data

Aug. 28, 2018 (CN) ..... 2018 1 0984108

(51) Int. Cl.

| | |
|---|---|
| ***G08G 1/08*** | (2006.01) |
| ***G08G 1/01*** | (2006.01) |
| ***G08G 1/083*** | (2006.01) |

(52) U.S. Cl.
CPC ..... *G08G 1/08* (2013.01); *G08G 1/0145* (2013.01); *G08G 1/083* (2013.01)

(58) Field of Classification Search
CPC ..... B60W 10/00; G08G 1/00
See application file for complete search history.

(56) References Cited

U.S. PATENT DOCUMENTS

2004/0054513 A1* 3/2004 Laird ..... G08G 1/054 703/8

FOREIGN PATENT DOCUMENTS

| | | | |
|---|---|---|---|
| CN | 104766484 | A | 7/2015 |
| CN | 107730922 | A | 2/2018 |

(Continued)

*Primary Examiner* — Shirley Lu
(74) *Attorney, Agent, or Firm* — Muncy, Geissler, Olds & Lowe, P.C.

(57) ABSTRACT

A method to schedule intelligent traffic lights in real time based on digital infochemicals (DIs) is disclosed. The method takes advantage of DIs as medium to both predicate traffic flow and smooth the green/Cycle (g/C) ratio. First collect DIs, then update DIs by three actions including aggregation, evaporation, and propagation. After that, adjust the g/C ratio of the traffic light. DIs have the function of prediction due to the propagation that allows DIs reach the traffic earlier than the real traffic flow. On the other hand, DIs have the function of memory due to the evaporation that remembers the information of the historical traffic flow. The prediction and memory of DIs, as the reason why DIs are superior to the pure traffic flow, give the DI-based intelligent traffic light compelling advantages over the pure traffic based intelligent traffic light.

2 Claims, 3 Drawing Sheets

(56) References Cited

FOREIGN PATENT DOCUMENTS

| | | | |
|---|---|---|---|
| CN | 108399740 | A | 8/2018 |
| CN | 109035811 | A | 12/2018 |

* cited by examiner (a)

(b)

METHOD TO SCHEDULE INTELLIGENT TRAFFIC LIGHTS IN REAL TIME BASED ON DIGITAL INFOCHEMICALS

TECHNICAL FIELD

The present invention belongs to the field of computer applied technology, and relates to a method to schedule intelligent traffic lights based on self-organization theory.

BACKGROUND

Recently, with the rapid development of internet and embedded technology, more and more intelligent traffic signaling systems are applied to urban transportation systems aiming to relieve worsening traffic congestion. A fundamental criterion of known intelligent traffic systems is to dynamically adjust the green/Cycle (g/C) ratio of the traffic light according to the traffic flows in different direction of an intersection, that is, the green light length of a specific road is positively proportional the traffic flow on the road. However, how to predict traffic flows and avoid severe vibration of g/C ratio is a great challenge of limiting the application of intelligent traffic lights, due to the unpredictability and suddenness of traffic flows.

Digital Infochemicals (DIs) are analogous to Biochemical substances that convey information between interactive elements mediated via the environment. (Kasinger H, Bauer B and Denzinger J. Design pattern for self-organizing emergent systems based on digital infochemicals. In: Proceedings of the sixth IEEE conference and workshops on engineering of autonomic and autonomous systems, 2009.) Receiving such DIs is able to activate the actions of receiver. DIs are classified into two types, one of which transmits within the same type of entities, while the other type of DIs are able to transmit within different type of entities. Ant colony (Colorni A. and Dorigo M. Distributed optimization by ant colonies. In: Proceedings of actes de la premiere conference europeenne sur la vie artificielle, Paris, France, 1991.) is a good example of DIs. In the natural world, ants lay down pheromone trails when traveling between the nest and the food resource locations. At the same time, the pheromone starts evaporating. Ants prefer following the trail with relatively more pheromones. Over time, the pheromones accumulate over the shorter paths than those on the longer ones, because the shorter paths take less time for ants to travel back and forth. On the other hand, higher pheromones attract more ants, which in turn reinforce pheromones. Thus, almost all the ants travel on the shortest path finally.

By analogy to natural infochemicals, DIs applied in decentralized self-organizing emergent systems serve as a coordination mechanism to communicate between homogeneous or heterogeneous agents in multi-agent models. The invention takes advantage of DIs as medium to control traffic lights so as to predict traffic flow and avoid tremendous vibration of g/C ratio.

SUMMARY OF THE INVENTION

Figure 1:
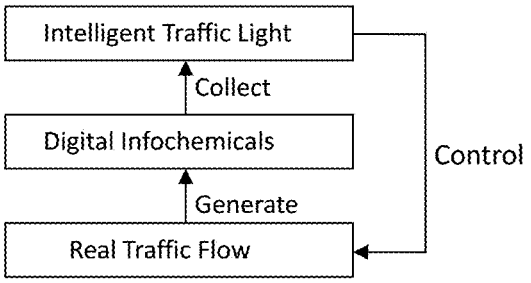

Aiming to solve the problems of known intelligent traffic lights, the invention takes advantage of DIs as medium to implement a method to predicate traffic flow and smooth the g/C ratio in real time. The traditional traffic lights adjust g/C ratio directly based on the traffic flow data in real time. The problem is the tremendous changes of green light length caused by unpredictability and suddenness of traffic flow. The invention adds a layer of DIs between traffic light controller and traffic flow, as shown in FIG. 1. Although derived from traffic flow, DIs are different from traffic flow, because the evaporation and propagation of DIs have the functionality of smoothing g/C ratio and predict the traffic flow.

Figure 2:
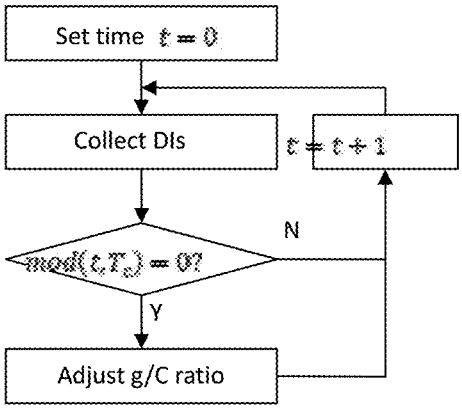

The technical solution of the invention is as shown in FIG. 2. At time t, firstly collect the DIs generated by real-time traffic flow. In the next step, check if time t is the beginning of a traffic light controlling cycle, i.e., $\mathrm{mod}(t,T_c)=0$. If time t is the beginning of a traffic controlling cycle, then adjust the g/C ratio for the next cycle, based on the collected DIs in the previous cycle. Otherwise, perform DIs collection task for time t+1. Such a process forms an infinite loop and keeps updating.

The technical solution in detail is as follows:

Step 1, Collect Digital Infochemicals

Figure 3:
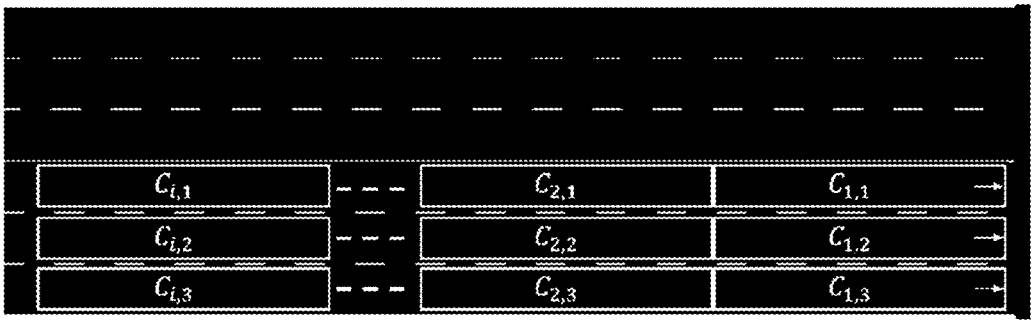

DIs are derived from the traffic flow. The vehicles leave DIs on the passed road. To simplify the computing complexity, the road is divided into several cells according to the requirements of the target, as shown in FIG. 3. At time t, the traffic light system automatically collects the DIs in each cell according to the real-time traffic flow. Then undergo aggregation, evaporation, and propagation to update the DIs.

The said aggregation refers to the accumulation of DIs generated by different vehicles within the same cell.

$$\rho_{i,t}=\rho_{i,t-1}+n_{i,t} \tag{1}$$

where, $\rho_{i,t-1}$ is number of DIs in the ith cell at time t−1; $n_{i,t}$ is the number of vehicles in the ith cell at time t; $\rho_{i,t}$ is the updated number of DIs in the ith cell at time t.

The said evaporation refers to the gradual deduction of DIs along with time going:

$$\rho_{i,t}=(1-\rho_v)\rho_{i,t} \tag{2}$$

where, $\rho_{i,t}$ is the number of DIs in the ith cell at time t; $\rho_v$ is the evaporation rate; $p_{i,t}'$, is the number of DIs left after evaporation.

The said propagation refers to that the DIs propagate to the neighboring areas along with the driving direction of vehicles.

$$\rho_{i,t}''=(1-\rho_p)\rho_{i,t}' \tag{3}$$

where, $\rho_{i,t}^{E}$ is the number of DIs left after evaporation; $\rho_\rho$ is the propagation rate, i.e., the percentage of DIs propagated to the neighboring areas; $\rho_{i,t}''$ the number of DIs left after propagation.

At the same time when the DIs in a cell propagate, the cell also receives the DIs propagated from other cells. Under synchronized update, the DIs in all the cells propagate simultaneously, and then receive the DIs propagated from other cells:

$$\rho_{i,t}'''=\rho_{i,t}''+\sum_{j\in\Phi}\rho_{j,t}^{p} \tag{4}$$

where, Φ is the set of upstream cells whose DIs are propagated to the ith cell; $\rho_{j,t}^{\rho}$ is the DIs propagated from the jth cell and sprayed to the passed cells evenly;

$$\rho_{j,t}^{p}=\frac{\rho_p\rho_{j,t}'}{v\tau/C_s} \tag{5}$$

where, $\rho_{j,t}'$ is the DIs left after evaporation; $\rho_\rho\rho_{j,t}'$ is the total DIs propagated to the neighboring areas; v is the speed for propagation; $\tau$ is the unit time length; $v\tau$ is the length that the DIs are able to propagate within time $\tau$; $C_s$ is the length of cell; $v\tau/C_s$ is the number of cells that the DIs pass during propagation within time $\tau$;

Step 2, Adjust Green/Cycle (g/C) Ratio

Assume t to be the beginning time of a signal cycle, i.e., $\mathrm{mod}(t,T_c)=0$, then the traffic signal light adjusts the g/C ratio for the next signal cycle according to the number of DIs on the adjacent roads of an intersection in the current cycle:

$$T_i^G = \frac{D_i}{\sum_j D_j} T_C \tag{7}$$

where, $T_i^G$ is the green duration of the ith phase; $D_i$ is the number of DIs on the roads corresponding to the ith phase; $\Sigma_j D_j$ is the total number of DIs on all the roads of an intersection; $T_c$ is the cycle length.

If t is not the beginning time of a signal cycle, then follow Step 1 to collect the DIs for the t+1 time. Such a process forms an infinite loop and keep updating.

Furthermore, the transportation simulation model utilizes discrete time strategy with 1 second as time step and 1 meter as the length of each cell; Equation 5 is simplified as:

$$\rho_{j,t}^p = \frac{\rho_p \rho_{j,t}'}{v} \tag{6}$$

The advantages of the invention are that the DIs are able to arrive at the traffic light before the actual traffic flow due to the propagation such that the DIs have the function of predication. On the other hand, the DIs have the information of previous traffic flow due to the evaporation such that the DIs have the function of memory. The predication and memory resulting from the DIs are the reasons why the DIs are better than the pure traffic flow. Thus, the intelligent traffic light based on the DIs have more advantages than the traffic light based on the pure traffic flow.

DESCRIPTIONS OF THE DRAWINGS

FIG. 1 The framework of the traffic light based on Dis.

FIG. 2 The real-time scheduling flow chart of the DIs-based traffic light.

FIG. 3 The illustration of DIs on the road.

Figure 4:
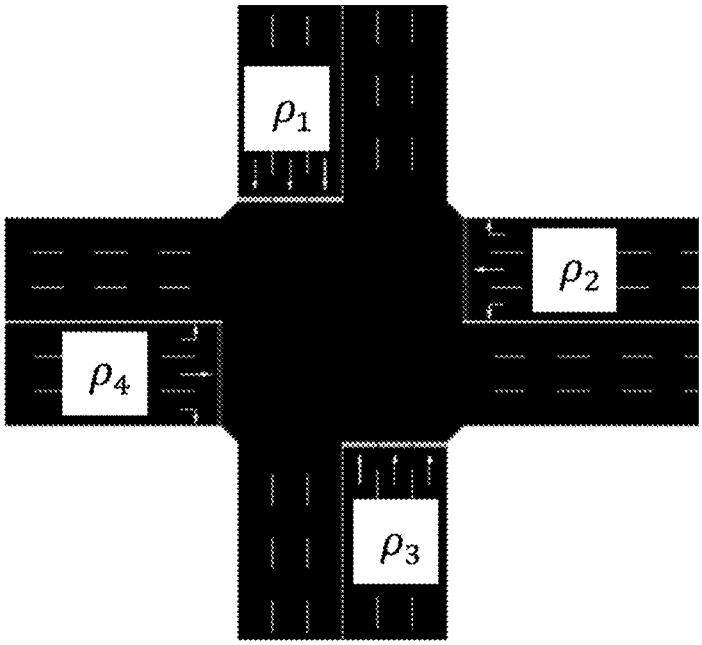

FIG. 4 The illustration of DIs at the intersection.

Figure 5:
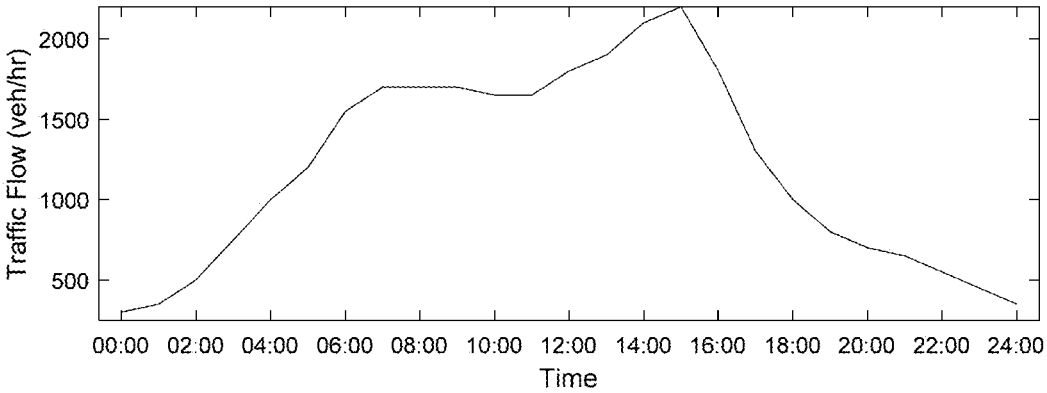

FIG. 5 The traffic changes on a main road.

Figure 6:
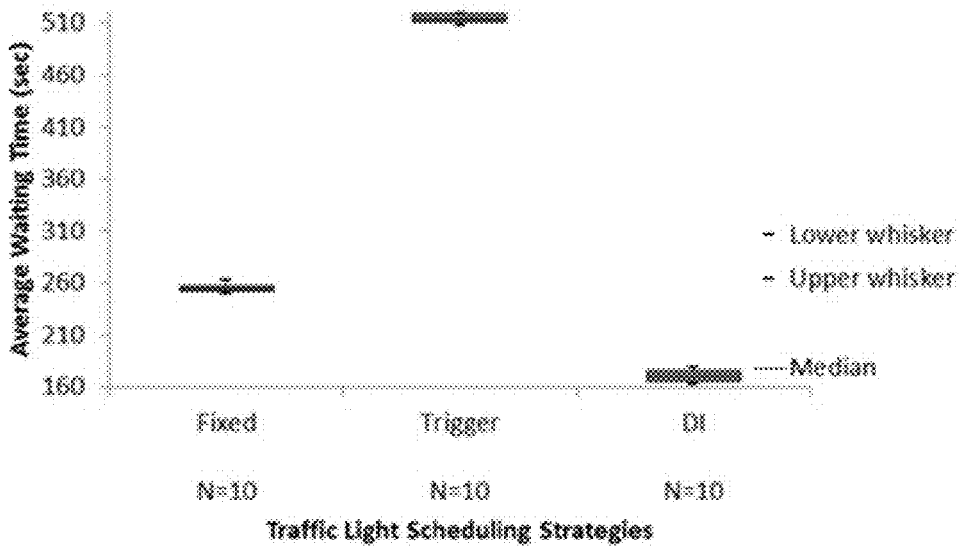
Figure 6:
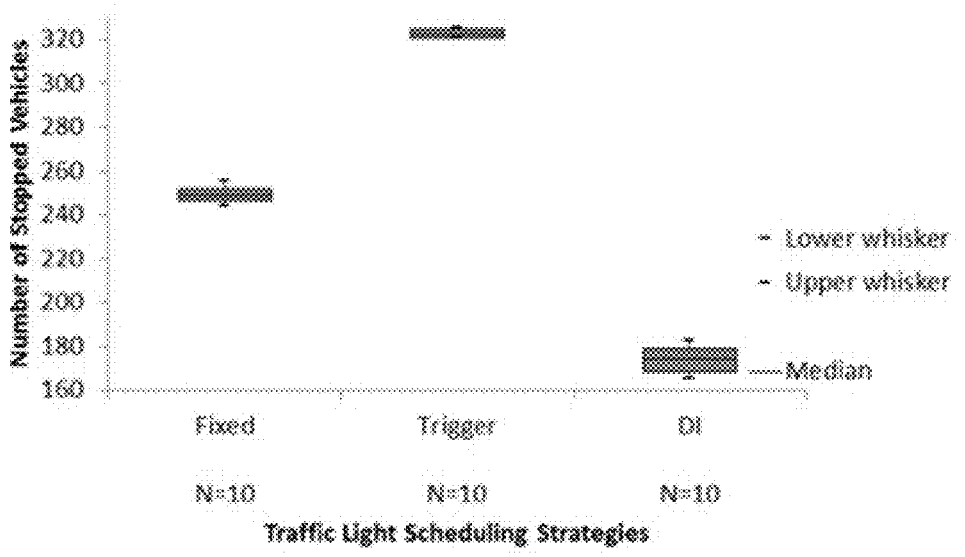

FIG. 6 The comparison of three traffic signaling strategies; (a) Boxplot of average waiting time, (b) Boxplot of average queuing length.

DETAILED DESCRIPTION

Have a two-way three-lane road as an example, shown in FIG. 3. The DIs are generated by the passing vehicles. Discrete time simulation is applied to exactly track the trajectory of vehicles, that is, updating the positions of vehicles in a specified time interval. Without loss of generality, the time interval is one second, that is, updating the positions of vehicles every second. Considering the fact that the nearby DIs have similar impacts on the traffic light, a road is split into cells with the same length, in which the DIs aggregate as a whole. Such a discrete strategy is beneficial to reduce computing workloads. The length of a cell in the following example is 10 meters.

Assume there are 2 vehicles in cell $C_{S,1}$ at time 0, then the DIs $\rho_{S,1}$ is 2.

Firstly, consider evaporation with the evaporation rate $\rho_v$ of 0.2/s that indicates 20% of DIs are evaporated every one second. Then $\rho_{S,1}$ changes to 1.6.

Next, consider propagation with the propagation rate $\rho_\rho$ of 0.3/s that indicates 30% of DIs diffuse to the downstream road. Then $\rho_{S,1}$ changes to 1.12.

Assume that the propagation speed is the same as the vehicles' traveling speed, i.e., 100 km/hr=28 m/s, which means the DIs propagate by 28 meters every second that is equivalent to 3 cells. The DIs propagated spray into the adjacent 3 cells evenly, i.e., $C_{4,1}$, $C_{3,1}$, $C_{2,1}$, and the DIs in each cell are increased by 1.6*0.3/3=0.16.

Cell $C_{5,1}$ also accepts the DIs propagated from the upstream 3 cells. Assuming the DIs propagated from cell $C_{6,1}$, $C_{7,1}$, $C_{8,1}$ are 0.1, 0.21, 0.08, respectively, $\rho_{5,1}$. finally changes to 1.12+0.1+0.21+0.08=1.51 at time 0.

Assuming there are 3 vehicles in cell $C_{5,1}$ at the next time, i.e., time 1, the DIs in the cell increase from the base 1.51 by 3, that is 4.51.

Firstly, consider evaporation with the evaporation rate $\rho_v$ of 0.2/s that indicates 20% of DIs are evaporated every one second. Then $\rho_{S,1}$ changes to 3.608.

Next, consider propagation with the propagation rate $\rho_\rho$ of 0.3/s that indicates 30% of DIs diffuse to the downstream road. Then $\rho_{S,1}$ changes to 2.5256. The DIs propagated spray into the adjacent 3 cells evenly, i.e., a, $C_{4,1}$, $C_{3,1}$, $C_{2,1}$, and the DIs in each cell are increased by 3.608*0.3/3=0.3608.

From what described above, the DIs on the road follow the same rule, that is, unlimitedly iterate aggregation, evaporation, and propagation, during which the number of DIs is updated dynamically with the real-time traffic flow. The intelligent traffic light introduced in this invention adjusts the phase duration of the traffic light based on the updated DIs so as to reduce congestion.

Considering the intersection as shown in FIG. 4, $\rho_1$, $\rho_2$, $\rho_3$, $\rho_4$ are the DIs on the four adjacent roads of the intersection. To simplify computing complexity, here only vehicles that move straight are taken into account. According to Eq. 7, we can compute the green phase duration for the west-east road is $$T_G^{WE} = T_R^{NS} = \frac{\rho_2 + \rho_4}{\rho_1 + \rho_2 + \rho_3 + \rho_4} T_C,$$

where, $T_G^{WE}$ and $T_R^{NS}$ are the green phase duration for the west-east and red phase duration for the north-south road, respectively. $T_C$ is a controlling cycle of the traffic light. The green phase duration for the north-south road is $$T_G^{NS} = T_R^{WE} = \frac{\rho_1 + \rho_2}{\rho_1 + \rho_2 + \rho_3 + \rho_4} T_C.$$

To evaluate the performance of the DIs-based traffic light, compare it to the traffic light controlled by fixed scheduling strategy and by trigger-based strategy. Fixed scheduling strategy predefine the phase durations according to historical traffic data, and keeps the phase duration unchanged once set up. The trigger-based strategy means that the traffic light on the main stream road keeps green during a signaling cycle until there are vehicles waiting on the road with relatively lower traffic. Then the traffic light on the road with relatively lower traffic changes to green for a certain period. The trigger-based strategy is designed to prioritize the traffic on the main stream road.

To compare these three traffic light scheduling strategies, the real traffic demand with peak hours is used as the testing data, as shown in FIG. 5. Each scheduling strategy is run 10 times, and then compare the generated average waiting time and average queuing length, as shown in FIG. 6. From the figure it is easy to observe that the DI-based scheduling strategy leads to shorter waiting time and short queuing length than the other two scheduling strategies.

The invention claimed is:

1. A method to schedule intelligent traffic lights in real time based on digital infochemicals, DIs, wherein comprising the following steps:

step 1, collect digital infochemicals according to the target requirements, a road is split into several cells; at time tick t, the traffic light system automatically collects the DIs generated by the traffic flow in each cell, and then updates the DIs through three processes, i.e., aggregation, evaporation, and propagation;

said aggregation refers to the accumulation of DIs generated by different vehicles within the same cell;

$$\rho_{i,t}=\rho_{i,t-1}+n_{i,t} \tag{1}$$

where, $\rho_{i,t-1}$ is number of DIs in the ith cell at time t−1; $n_{i,t}$ is the number of vehicles in the ith cell at time t; $\rho_{i,t}$ is the updated number of DIs in the ith cell at time t;

said evaporation refers to the gradual deduction of DIs along with time going:

$$\rho_{i,t}'=(1-\rho_v)\rho_{i,t} \tag{2}$$

where, $\rho_{i,t}$ is the number of DIs in the ith cell at time t; $\rho_v$ is the evaporation rate; $\rho_{i,t}'$ is the number of DIs left after evaporation;

said propagation refers to that the DIs propagate to the neighboring areas along with the driving direction of vehicles:

$$\rho_{i,t}''=(1-\rho_p)\rho_{i,t}' \tag{3}$$

where, $\rho_{i,t}''$ is the number of DIs left after evaporation; $\rho_\rho$ is the propagation rate, i.e., the percentage of DIs propagated to the neighboring areas; $\rho_{i,t}''$ the number of DIs left after propagation;

under synchronized update, the DIs in all the cells propagate simultaneously, and then receive the DIs propagated from other cells:

$$\rho_{i,t}'''=\rho_{i,t}''+\sum_{j\in\Phi}\rho_{j,t}^{p} \tag{4}$$

where, Φ is the set of upstream cells whose DIs are propagated to the ith cell; $\rho_{j,t}^{\rho}$ is the DIs propagated from the jth cell and sprayed to the passed cells evenly;

$$\rho_{j,t}^{p}=\frac{\rho_p\rho_{j,t}'}{v\tau/C_s} \tag{5}$$

where, $\rho_{j,t}'$ is the DIs left after evaporation; $\rho_\rho\rho_{j,t}'$ is the total DIs propagated to the neighboring areas; v is the speed for propagation; τ is the unit time length; vτ is the length that the DIs are able to propagate within time τ; $C_S$ is the length of cell; $v\tau/C_S$ is the number of cells that the DIs pass during propagation within time τ;

step 2, adjust Green/Cycle, g/C, ratio assume t to be the beginning time of a signal cycle, i.e., mod(t,$T_c$)=0, then the traffic signal light adjusts the g/C ratio for the next signal cycle according to the number of DIs on the adjacent roads of an intersection in the current cycle:

$$T_i^G=\frac{D_i}{\sum_j D_j}T_C \tag{7}$$

where, $T_i^G$ is the green duration of the ith phase; $D_i$ is the number of DIs on the roads corresponding to the ith phase; $\Sigma_j D_j$ is the total number of DIs on all the roads of an intersection; $T_C$ is the cycle length;

if t is not the beginning time of a signal cycle, then follow Step 1 to collect the DIs for the t+1 time; such a process forms an infinite loop and keep updating.

2. The method to schedule intelligent traffic lights in real time based on digital infochemicals according to claim 1, wherein the transportation simulation model utilizes discrete time strategy with 1 second as time step and 1 meter as the length of each cell; Equation 5 is simplified as:

$$\rho_{j,t}^{p}=\frac{\rho_p\rho_{j,t}'}{v}. \tag{6}$$

* * * * *